US009372490B1

(12) United States Patent
Kose et al.

(10) Patent No.: US 9,372,490 B1
(45) Date of Patent: Jun. 21, 2016

(54) SYSTEM AND METHOD FOR DISTRIBUTED VOLTAGE REGULATOR-GATING

(71) Applicants: Selcuk Kose, Tampa, FL (US); Orhun Aras Uzun, Tampa, FL (US)

(72) Inventors: Selcuk Kose, Tampa, FL (US); Orhun Aras Uzun, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 14/549,120

(22) Filed: Nov. 20, 2014

Related U.S. Application Data

(63) Continuation of application No. 14/279,892, filed on May 16, 2014, now Pat. No. 8,922,272.

(51) Int. Cl.
*G05F 1/10* (2006.01)
*G05F 1/56* (2006.01)

(52) U.S. Cl.
CPC ..... *G05F 1/56* (2013.01)

(58) Field of Classification Search
CPC ..... G05F 1/462; G05F 1/465; G05F 1/56; G05F 1/577
See application file for complete search history.

(56) References Cited

U.S. PATENT DOCUMENTS

| | | | | |
|---|---|---|---|---|
| 4,359,679 | A | 11/1982 | Regan | |
| 5,721,485 | A | 2/1998 | Hsu et al. | |
| 7,872,886 | B2 | 1/2011 | Xu et al. | |
| 8,294,429 | B2 | 10/2012 | Fuller et al. | |
| 8,378,657 | B2 | 2/2013 | Dobkin | |
| 8,564,262 | B2 | 10/2013 | Bose et al. | |
| 8,680,826 | B2 | 3/2014 | Kondo et al. | |
| 2009/0278517 | A1 * | 11/2009 | Kleveland | G05F 1/563 323/272 |

* cited by examiner

*Primary Examiner* — Jeffrey Zweizig
(74) *Attorney, Agent, or Firm* — Molly L. Sauter; Smith & Hopen, P.A.

(57) ABSTRACT

A system and method for adaptive activity management of on-chip voltage regulators based upon the workload information is provided to force each on-chip regulator to operate in its most power-efficient load current. In the proposed regulator-gating technique, regulators are adaptively turned ON when the current demand is high and turned OFF when the current demand is low to improve the voltage conversion efficiency. With the proposed regulator-gating system and method, the overall voltage conversion efficiency from the battery or off-chip power supply to the output of the on-chip voltage regulators experiences an approximately 3 times improvement over the prior art techniques.

21 Claims, 7 Drawing Sheets

SYSTEM AND METHOD FOR DISTRIBUTED VOLTAGE REGULATOR-GATING

CROSS-REFERENCE TO RELATED APPLICATIONS

This application is a continuation of, and claims priority to, currently pending U.S. patent application Ser. No. 14/279,892, entitled "System and Method for Voltage Regulator-Gating", having a filing date of May 16, 2014, the entirety of which is hereby incorporated by reference.

BACKGROUND OF THE INVENTION

With continuous advancements in the semiconductor industry, transistors with smaller than 20 nm feature size have enabled the integration of multi-billion transistors on a single die. With the failure of MOSFET scaling however, only a fraction of the transistors on a die can operate at full voltage/frequency to not exceed the thermal design power (TDP). A large proportion of the circuit blocks is either inactive (dark silicon) or in a reduced-power state (dim silicon) at any given time to satisfy the power and thermal constraints. Despite the significant amount of research and growing necessity for a holistic power optimization technique, existing efforts to minimize power dissipation are typically not coherent. The existing research efforts are disjointed into two pieces: 1) the dynamic and static power loss at the load circuits is minimized or 2) the power loss during power-conversion is minimized.

There is a growing trend for integrating the voltage regulators fully on-chip to improve the quality of voltage delivered to the load circuits. Voltage regulators are typically designed to provide the highest power-conversion efficiency when delivering a particular output current regime, typically the maximum current for LDO (low-dropout) and SC (switched capacitor) regulators. Since dynamically changing the design parameters of a voltage regulator under different workloads is difficult, existing power management techniques suffer from increased voltage conversion losses during idle states when the current demand is low and regulator efficiency is reduced.

In modern mobile platforms, more than 32% of the overall battery power is dissipated during high-to-low voltage conversion before the power even reaches the load circuits. The primary reason for this huge power loss is that power delivery networks are designed to satisfy the stringent noise requirements under worst-case loading conditions, which is typically the full utilization of the overall chip computing and memory resources when the current demand is the highest.

Parallel voltage regulation has been widely used for buck and SC regulators to reduce the output voltage ripple by interleaving multiple regulators with phase shifted switching frequencies. Advantages of interleaved regulation include reduced filter size for buck converters, improved load response, and higher efficiency. The interleaved architectures, however, have not been exploited until recently to regulate voltage close to the load circuits to minimize noise. Distributed on-chip voltage regulation is an emerging research area where multiple voltage regulators are connected in parallel, delivering current to the same power network close to the load circuits. Although challenges such as device mismatch, offset voltages among parallel regulators, overall system stability, and balanced current sharing need to be considered, distributed voltage regulation can provide sub-nanosecond load regulation to attain high performance under increased temporal and spatial workload variations in modem ICs. Aggressive power saving mechanisms are currently implemented as a result of the modem ICs exhibiting frequent idle periods. It is projected that more than half of the circuit needs to be idle at 8 nm technology node to satisfy the TDP requirement in server processors or to improve the battery life in mobile processors.

Design-for-power has become one of the primary objectives resulting from the continuous demand to improve the battery life of mobile devices or to minimize the cooling costs of servers. To save power and mitigate thermal emergencies, circuits typically enter reduced power states when the workload is light. Prior art voltage regulators, however, operate indifferently under varying workload conditions due to a lack of different operating modes. When a prior art voltage regulator is optimized for a particular load current, significant power is dissipated during voltage conversion while delivering power to a different load current than the load current for which the voltage regulator is optimized.

Accordingly, what is needed in the art is an improved system and method for voltage conversion efficiency at different utilization levels for on-chip voltage regulators.

SUMMARY OF INVENTION

A system and method for adaptive activity management of on-chip voltage regulators based upon the workload information is provided to force each on-chip regulator to operate in its most power-efficient load current. In the proposed regulator-gating technique, regulators are adaptively turned ON when the current demand is high and turned OFF when the current demand is low to improve the voltage conversion efficiency. With the proposed regulator-gating system and method, the overall voltage conversion efficiency from the battery or off-chip power supply to the output of the on-chip voltage regulators experiences an approximately 3 times improvement over the prior art techniques.

In accordance with the present invention, a method for adaptive management of an on-chip distributed power network, the on-chip distributed power network comprising a set of on-chip voltage regulators coupled in parallel to one or more load circuits, is provided. In one embodiment, the method includes determining an output current at a selected power-conversion efficiency level for each of the on-chip voltage regulators included in the set of on-chip voltage regulators, determining a current demand of the one or more load circuits coupled to the on-chip voltage regulators and turning ON a subset of the set of on-chip voltage regulators based at least in part on the current demand of the one or more load circuits and the output current of each of the on-chip voltage regulators of the set of on-chip voltage regulators at the selected power-conversion efficiency level.

In a specific embodiment of the present invention, the selected power-conversion efficiency level is a highest efficiency level and the subset of the set of on-chip voltage regulators is a minimum number of on-chip voltage regulators required to meet the current demand of the one or more load circuits based at least in part on the output current of each of the plurality of on-chip voltage regulators.

To improve the voltage conversion efficiency, the present invention additionally provides a system for adaptive management of an on-chip distributed power network. In one embodiment, the system includes an on-chip distributed power network comprising a set of on-chip voltage regulators coupled in parallel to one or more load circuits, each of the on-chip voltage regulators of the set of on-chip voltage regulators having an output current equal to the output current of the voltage regulator at a selected efficiency level, one or more power sensors configured for determining a current demand of the one or more load circuits coupled to the set of on-chip voltage regulators and a power controller coupled to the on-chip distributed power network, the power controller configured for turning ON a subset of the set of on-chip voltage regulators based at least in part on the current demand of the one or more load circuits and the output current of each of the on-chip voltage regulators at the selected power-conversion efficiency level.

In a particular embodiment of the present invention, the selected power-conversion efficiency level is a highest efficiency level and the subset of the set of on-chip voltage regulators is a minimum number of on-chip voltage regulators required to meet the current demand of the one or more load circuits based at least in part on the output current of each of the plurality of on-chip voltage regulators.

In accordance with the present invention, an improved system and method for voltage conversion efficiency at different utilization levels for on-chip voltage regulators is provided.

BRIEF DESCRIPTION OF THE DRAWINGS

For a fuller understanding of the invention, reference should be made to the following detailed description, taken in connection with the accompanying drawings, in which:

FIG. 1(*b*) is a graph illustrating the current efficiency of an LDO regulator that increases monotonically with the load current when the quiescent current is constant.

FIG. 1(*c*) is a graph illustrating how the adaptive control of the quiescent current based upon the load current can improve the current efficiency of an LDO regulator.

FIG. 2(*b*) is a graph illustrating how various techniques can be used to improve the efficiency at light load currents.

FIG. 4(*b*) is a circuit diagram of a DLDO voltage regulator in accordance with an embodiment of the present invention.

FIG. 6(*b*) is a graphical illustration of the response time of DLDO 2 of multiple LDO and DLDO voltage regulators connected in parallel to the same power grid when the load current is increased from 11 mA to 80 mA.

FIG. 6(*c*) is a graphical illustration of the response time of DLDO 3 of multiple LDO and DLDO voltage regulators connected in parallel to the same power grid when the load current is increased from 11 mA to 80 mA.

FIG. 6(*d*) is a graphical illustration of the response time of LDO 1 of multiple LDO and DLDO voltage regulators connected in parallel to the same power grid when the load current is increased from 11 mA to 80 mA.

FIG. 6(*e*) is a graphical illustration of the response time of LDO 2 of multiple LDO and DLDO voltage regulators connected in parallel to the same power grid when the load current is increased from 11 mA to 80 mA.

FIG. 6(*f*) is a graphical illustration of the response time of LDO 3 of multiple LDO and DLDO voltage regulators connected in parallel to the same power grid when the load current is increased from 11 mA to 80 mA.

FIG. 6(*g*) is a graphical illustration of the response time of LDO 4 of multiple LDO and DLDO voltage regulators connected in parallel to the same power grid when the load current is increased from 11 mA to 80 mA.

FIG. 6(*h*) is a graphical illustration of the response time of LDO 5 of multiple LDO and DLDO voltage regulators connected in parallel to the same power grid when the load current is increased from 11 mA to 80 mA.

FIG. 6(*i*) is a graphical illustration of the response time of LDO 6 of multiple LDO and DLDO voltage regulators connected in parallel to the same power grid when the load current is increased from 11 mA to 80 mA.

FIG. 6(*j*) is a graphical illustration of the response time of LDO 7 of multiple LDO and DLDO voltage regulators connected in parallel to the same power grid when the load current is increased from 11 mA to 80 mA.

FIG. 6(*k*) is a graphical illustration of the response time of $I_{out}$ for multiple LDO and DLDO voltage regulators connected in parallel to the same power grid when the load current is increased from 11 mA to 80 mA.

FIG. 6(*l*) is a graphical illustration of the response time of $V_{out}$ for multiple LDO and DLDO voltage regulators connected in parallel to the same power grid when the load voltage is increased from 950 mV to 1030 mV.

DETAILED DESCRIPTION OF THE PREFERRED EMBODIMENT

A new parallel voltage regulation architecture and regulator management technique is proposed to improve the voltage conversion efficiency at different utilization levels.

Voltage regulators are optimized at a particular output current, assuming that the regulator typically operates at that particular current regime. The voltage conversion efficiency during the idle periods is therefore significantly degraded since the voltage regulators are almost always designed to provide the highest power efficiency at the higher load current.

Figures 1, 1A, 1B, 1C:
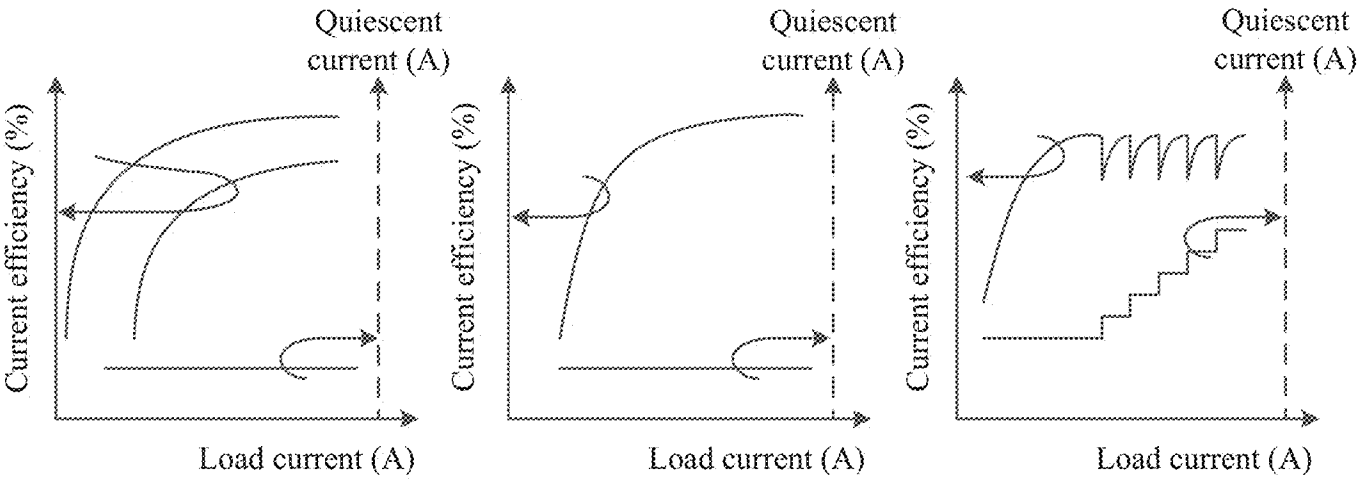
FIG. 1(*a*) is a graph illustrating the current efficiency of an LDO regulator that is significantly degraded when the quiescent current increases at light load currents.
Figure 2:
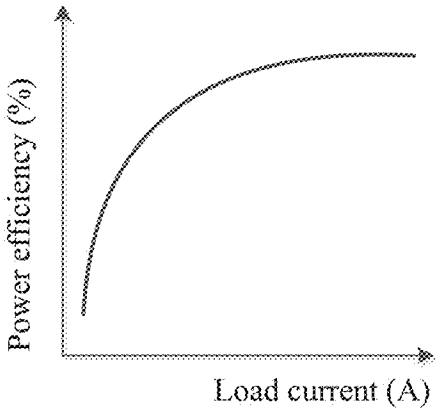
FIG. 2(*a*) is a graph illustrating that the power efficiency of an SC regulator is not necessarily monotonic, but the maximum efficiency is typically obtained while delivering maximum output current.
Figure 2:
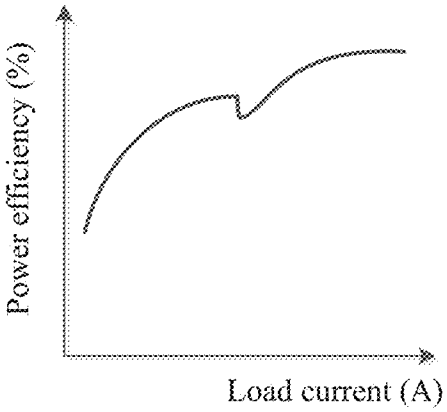
Figure 3:
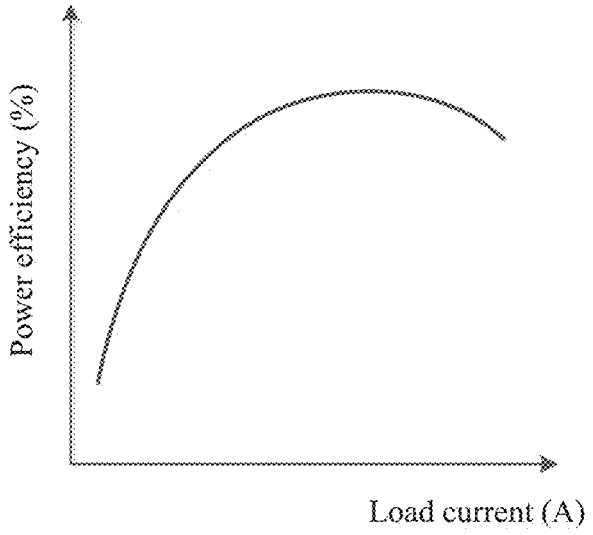
FIG. 3 is a graphical illustration of the power efficiency of buck converters, wherein the efficiency graph exhibits a non-monotonic behavior and the maximum power efficiency is not obtained at the full output current.

The power efficiency of low-dropout (LDO) regulators, switched capacitor (SC) regulators, and buck converters are illustrated in FIGS. 1,2 and 3, respectively. The current efficiency of an LDO regulator depends on the quiescent current consumption within the regulator. Although the efficiency of an LDO regulator can be improved by adaptively changing the quiescent current, current efficiency is significantly degraded at light load currents, as shown in FIGS. 1(*a*), 1(*b*) and 1(*c*). The power efficiency of an SC regulator typically increases with the output current as shown in FIG. 2(*a*). Although advanced techniques can be used to improve the efficiency at light load currents, as illustrated in FIG. 2(*b*), the efficiency is typically significantly degraded while providing light output current. The power efficiency of a buck converter exhibits a non-monotonic behavior and efficiency is degraded when the load current exceed a certain value. Similar to the other regulator types, the power efficiency of a buck converter is minimized while delivering light load current, as shown in FIG. 3.

As compared to the conventional schemes where the power network is designed targeting the full utilization of the overall chip area, the proposed technique will provide an adaptive power delivery infrastructure that is tailored to provide high voltage conversion efficiency during both fully-utilized and under-utilized modes of operation. One of the primary challenges is to realize a voltage regulator with fast (a couple of nanoseconds) turn on and off capability. Voltage regulators with fast turn on and off capability tailored to achieve an adaptive regulator-gating methodology are provided by the embodiments of the present invention.

In accordance with the present invention, a distributed power delivery network is constructed with parallel LDO and digital-LDO (DLDO) regulators to provide the proposed regulator-gating methodology. Although the detailed description describes the use of the regulator-gating method with LDO regulators, it is not intended to be limiting and it is within the scope of the present invention to also utilize the regulator-gating method with parallel SC and DLDO regulators. LDO and DLDO regulators are discussed in the following description since parallel LDO regulators tend to have more stability problems and are considered to be more difficult to realize.

Figure 4:
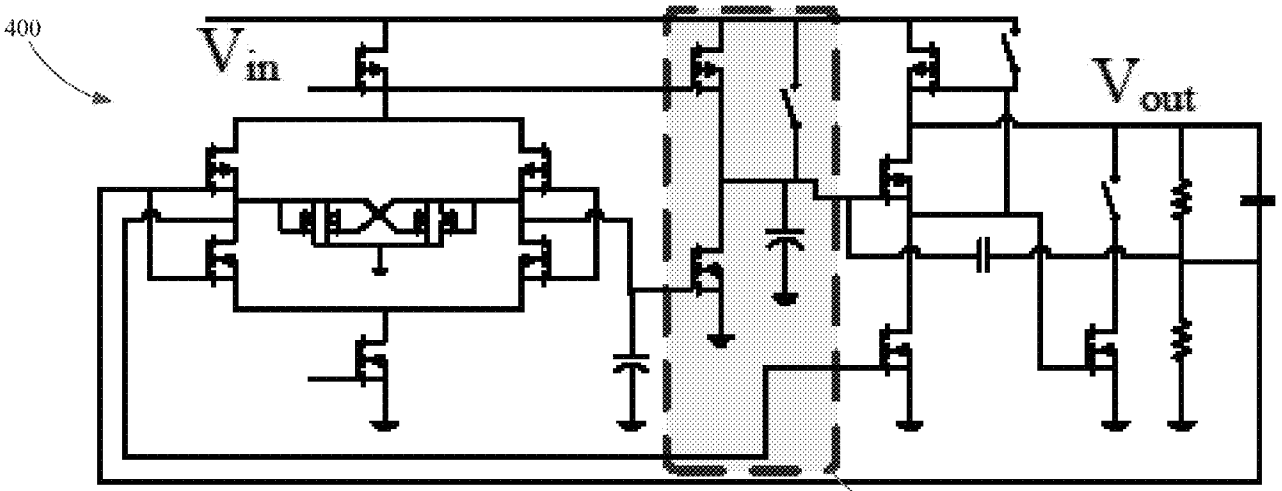
FIG. 4(*a*) is a circuit diagram of an LDO voltage regulator in accordance with an embodiment of the present invention.
Figure 4:
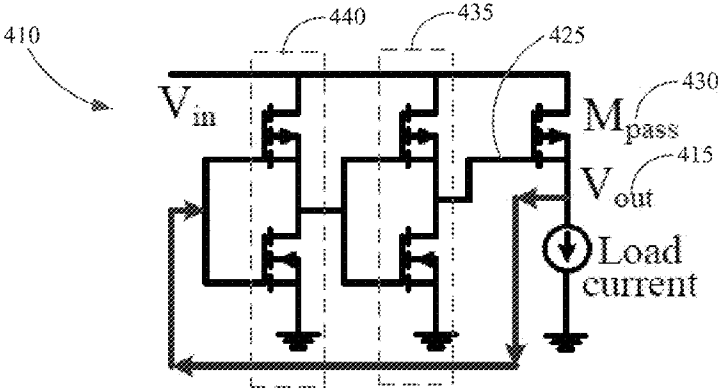

In accordance with an embodiment of the present invention, a DLDO regulator 410 with two skewed inverters 435, 440 to sense the changes at the output voltage ($V_{out}$) 415 and to generate a transient signal 425 to control the gate voltage of a pass transistor ($M_{pass}$) 430, permitting an instant response to transient changes is shown with reference to FIG. 4(*b*) is provided. A drop at the output voltage $V_{out}$ 415 causes the pass transistor ($M_{pass}$) 430 to provide higher current due to the increased gate voltage 425. In the DLDO regulator of the present invention, due to the smaller area of the sense transistors, multiple copies of this modified DLDO regulator 410 can be distributed across the die in parallel with the LDO 400 regulators providing a fast response time of ~400 ps, as shown with reference to FIG. 6. Multiple copies of these DLDO regulators 410 are connected in parallel with the LDO regulators 400, as illustrated in FIG. 4A. The inverting amplifier stage of the LDO regulator 405, shown in the dotted box in FIG. 4A, has been modified to enhance the dynamic response while minimizing the quiescent current consumption at this stage.

Figure 5:
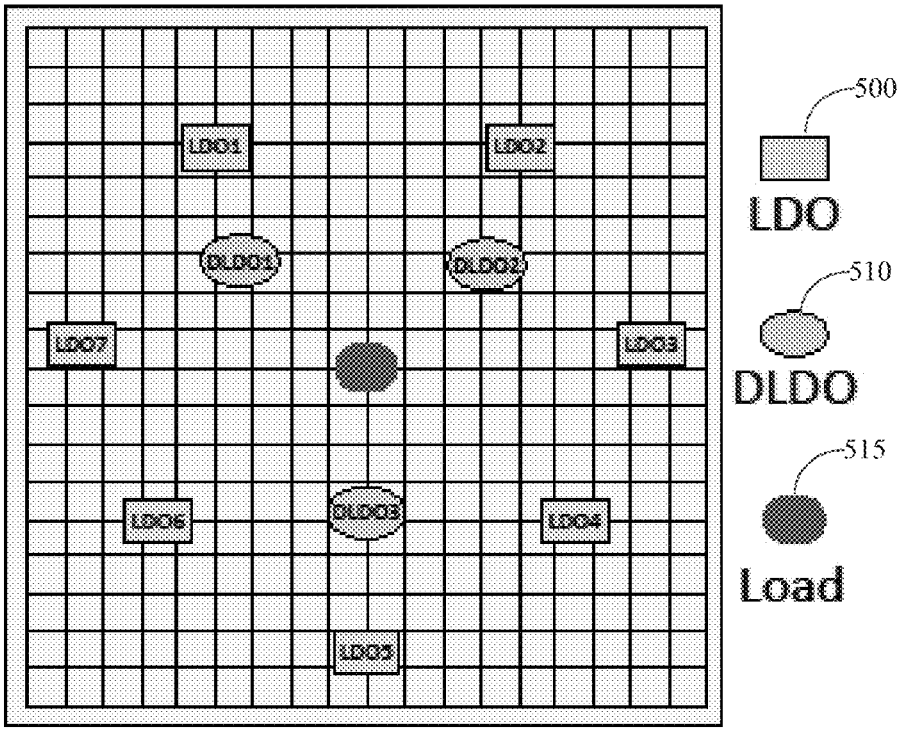
FIG. 5 is a diagrammatic illustration of a distributed power network with 7 LDO and 3 DLDO voltage regulators connected in parallel, in accordance with an embodiment of the present invention.
Figure 6:
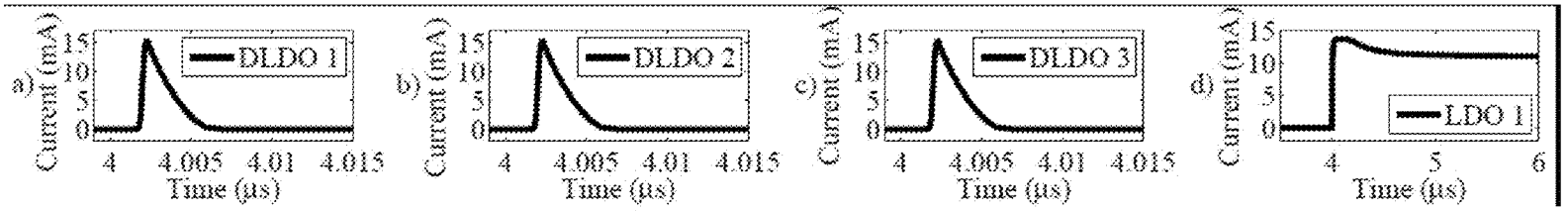
FIG. 6(*a*) is a graphical illustration of the response time of DLDO 1 of multiple LDO and DLDO voltage regulators connected in parallel to the same power grid when the load current is increased from 11 mA to 80 mA.

In one embodiment, the set of regulators includes seven LDO 500 and three DLDO 510 on-chip voltage regulators are connected to a small distributed power network with 400 nodes, as depicted in FIG. 5. The current contribution from individual regulators to the power grid is shown in FIG. 6 as the load 515 current demand increases from 11 mA to 80 mA. While only one LDO regulator (LDO 7) is sufficient to provide a robust 11 mA current to the load, a subset of the set of LDO regulators turn on and start providing current to the power grid when the load current demand increases to 80 mA. DLDO regulators turn on immediately after sensing a voltage drop at the power grid and provide instant current to the grid while the LDO regulators are turning on, as shown in FIG. 6. The DLDO regulators remain active only for a couple of nanoseconds until the LDO regulators turn on. The DLDO regulators are self-activated, whereas the LDO regulators are controlled by the system-level (global) controller, as explained in the following description.

The current efficiency of the LDO regulators is around 98% (~300 μA quiescent current while providing 11 mA current). The quiescent current increases while providing a lower output current and doubles to ~600 μA when the output current is lower than 2 mA. In this case, the current efficiency of the LDO regulator becomes 2/2.6=~77%. The increase in the quiescent current is typically observed when an LDO regulator has an AB amplifier type output stage. In the case study where the load current is 11 mA, a single LDO regulator provides the required current with 98% current efficiency. If all of the seven LDO regulators were active while providing 11 mA load current, each LDO regulator would contribute less than 2 mA current to the load with a current efficiency of less than 77%. Without regulator-gating, the total power dissipated during voltage conversion while providing 11 mA load current is $V_{in}*I_{in}-V_{out}*I_{out}$=1.2 V*(11 mA+7*0.6 mA)−1 V*11 mA=7.24 mW. Alternatively, with regulator-gating, the total power dissipated during voltage conversion is $V_{in}*I_{in}-V_{out}*I_{out}$=1.2 V*11.3 mA−1 V*11 mA=2.56 mW. These results demonstrate that the power delivery system is ~3× more power-efficient with the regulator-gating method of the present invention when certain regulators are gated during the idle periods of time. If the idle period lasts 1 ms, the energy savings will be greater than 8 μJ for this sample circuit.

On-chip voltage regulation introduces certain overheads, such as area and reduced power efficiencies. In spite of these overheads, on-chip voltage regulation can enable per-core-DVFS, lower the on-chip noise and reduce the number of dedicated I/O pins. The primary overheads of the regulator-gating of the present invention, assuming that the system already has on-chip voltage regulation, include: (1) Speed of regulator-gating: With the utilization of DLDO regulators, the turn on time is decreased to sub-nanosecond range (400 ps in the present example). For most of the applications, this turn on time does not degrade system performance; (2) Area overhead of regulator-gating: Assuming that the power delivery network already has control circuitry for power/clock gating, on-chip voltage or current sensors and performance counters, the area overhead of regulator-gating will be the additional area requirement for the DLDO regulators. Note that DLDO regulators already exist in certain designs without employing the regulator-gating techniques of the present invention. Additionally, when a firmware is used, there is no additional area overhead for regulator-gating power management; and (3) Power overhead of regulator-gating: The additional power overhead of the proposed regulator-gating methodology occurs during turning on and off voltage regulators. The power dissipation to turn on an LDO is less than ~0.1 mW, and the power dissipated by the DLDO is negligible (i.e. ~0.02 mW) when providing 15 mA output current.

Figure 7:
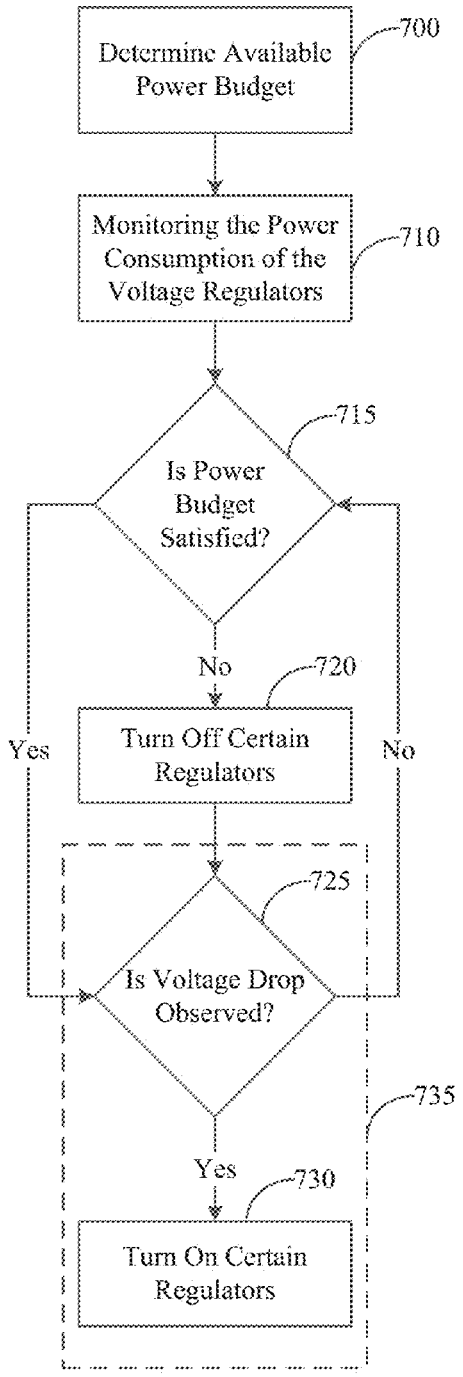
FIG. 7 is flow diagram illustrating the regulator-gating method in accordance with the present invention.

The proposed regulator-gating control methodology is based on two control loops: i) local control and ii) global control, as illustrated in FIG. 7. In the present invention the method includes, determining the available power budget of the on-chip voltage regulators 700 and monitoring the power consumption of the on-chip voltage regulators 710. The available power budget of the on-chip voltage regulators is dependent upon the operating voltage and current of the voltage regulators and defines the maximum power dissipation available to the on-chip voltage regulators. The method additionally identifies how many of the voltage regulators are active and if the power budget is satisfied 715. If the power budget is not satisfied, the power controller may turn off certain regulators 720. If the power budget is satisfied, the method continues, and if a voltage drop is observed 725 the DLDO voltage regulators may turn ON and then certain of the low-dropout voltage regulators may be turned back ON 730. In accordance with the invention, a local control 735 provides a sub-nanosecond response to the transient changes in the supply voltage. DLDO regulators are immediately activated based on a simple voltage feedback and provide instant current to the power grid in ~400 ps. When the voltage emergency is over (i.e, the transient spike is mitigated), these burst mode DLDO regulators are self-deactivated and wait for another interrupt to be activated. Alternatively, a global control loop continuously monitors the overall power consumption of the distributed regulators and compares this information with the available power budget dictated by the system-level controller. If the power consumption exceeds the available power budget limit, certain regulators are turned OFF. Global and local control loops are fundamentally separate during normal operation, however, the global control loop can override the local control at any time during the operation and can permanently turn OFF the regulators which are actually controlled locally. When the global controller turns a voltage regulator OFF, the local control loop cannot turn the regulator ON unless the global controller asserts the turn ON signal. The proposed power management system is partially implemented at the circuit level as demonstrated in the previous section that includes the local control and a portion of the global control which is illustrated in the dotted box in FIG. 7.

More than 32% of the overall power is dissipated during voltage conversion modern integrated circuits. The regulator-gating power management technique of the present invention improves the voltage conversion efficiency of the system by adaptively controlling the activity of individual voltage regulators within a set of parallel on-chip voltage regulators. In an exemplary embodiment, the proposed regulator-gating technique achieves ~3× lower power consumption during voltage conversion in a sample circuit with seven LDO and three DLDO regulators which are connected in parallel. The DLDO regulator of the present invention provides fast turn on capability and power management to control the regulator-gating with minimal increase is additional overhead.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A method for adaptive management of an on-chip distributed power network, the on-chip distributed power network comprising a set of on-chip voltage regulators coupled in parallel to one or more load circuits, the method comprising:

determining an output current at a selected power-conversion efficiency level for each of the on-chip voltage regulators included in the set of on-chip voltage regulators;

determining a current demand of the one or more load circuits coupled to the on-chip voltage regulators;

sensing, with a first voltage regulator coupled in parallel with the set of on-chip voltage regulators, an output voltage of the one or more load circuits;

providing a current from the first voltage regulator to the on-chip distributed power network in response to a drop in the output voltage of the one or more load circuits; and turning ON a subset of the set of on-chip voltage regulators based at least in part on the current demand of the one or more load circuits and the output current of each of the on-chip voltage regulators of the set of on-chip voltage regulators at the selected power-conversion efficiency level, while the first voltage regulator is providing the current to the on-chip distributed power network.

2. The method of claim 1, wherein the selected power-conversion efficiency level is a highest efficiency level.

3. The method of claim 1, wherein the subset of the set of on-chip voltage regulators is a minimum number of on-chip voltage regulators required to meet the current demand of the one or more load circuits based at least in part on the output current of each of the plurality of on-chip voltage regulators.

4. The method of claim 1, wherein the first voltage regulator is a digital low-dropout voltage regulator and the method, further comprises:

wherein sensing, with a first voltage regulator coupled in parallel with the set of on-chip voltage regulators, an output voltage of the one or more load circuits further comprises, sensing, with a voltage sensing circuit of the digital low-dropout voltage regulator, the output voltage of the one or more load circuits;

generating, by the voltage sensing circuit of the digital low-dropout voltage regulator, a gate control voltage in response to a drop in the output voltage of the one or more load circuits;

controlling a gate voltage of a pass transistor of the digital low-dropout voltage regulator using the gate control voltage generated b the voltage sensing circuit;

wherein providing a current from the first voltage regulator to the on-chip distributed power network in response to a drop in the output voltage of the one or more load circuits, further comprises, providing the current from the pass transistor of the digital low-dropout voltage regulator, to the on-chip distributed power network in response to the drop in output voltage of the one or more load circuits; and wherein turning ON a subset of the set of on-chip voltage regulators based at least in part on the current demand of the one or more load circuits and the output current of each of the on-chip voltage regulators of the set of on-chip voltage regulators at the selected power-conversion efficiency level, while the first voltage regulator is providing the current to the on-chip distributed power network further comprises, turning ON the subset of the set of on-chip voltage regulators based at least in part on the current demand of the one or more load circuits and the output current of each of the on-chip voltage regulators of the set of on-chip voltage regulators at the selected power-conversion efficiency level, while the pass transistors of the digital low-dropout voltage regulator is providing the current to the on-chip distributed power network in response to the drop in output voltage of the one or more load circuits.

5. The method of claim 1, further comprising:

determining the available power budget of the on-chip distributed power network;

identifying the subset of on-chip voltage regulators that have been turned ON; and turning OFF one or more of the on-chip voltage regulators of the subset of on-chip voltage regulators if the power budget is not satisfied by the subset of on-chip voltage regulators that have been turned ON.

6. The method of claim 1, wherein turning ON a subset of the set of on-chip voltage regulators based at least in part on the current demand of the one or more load circuits and the output current of each of the on-chip voltage regulators of the set of on-chip voltage regulators at the selected power-conversion efficiency level, while the first voltage regulator is providing the current to the on-chip distributed power network, further comprises:

sensing, with the first voltage regulator coupled in parallel with the set of on-chip voltage regulators, an output voltage of the on-chip distributed power network;

providing a current, from the first voltage regulator, to the on-chip distributed power network in response to the drop in output voltage of the on-chip distributed power network; and turning ON the subset of the on-chip voltage regulators based at least in part on the current demand of the one or more load circuits and the output current of each of the on-chip voltage regulators of the set of on-chip voltage regulators at the selected power-conversion efficiency level while the first voltage regulator is providing a current to the on-chip distributed power network in response to the drop in output voltage of the on-chip distributed power network.

7. The method of claim 6, further comprising disabling the current from the voltage sensing circuit after the subset of on-chip voltage regulators have been turned ON.

8. The method of claim 6, wherein the first voltage regulator is a digital low-dropout voltage regulator, the method further comprising:

sensing the output voltage of the on-chip distributed power network, with a voltage sensing circuit of the digital low-dropout voltage regulator;

generating, by the voltage sensing circuit of the digital low-dropout voltage regulator, a gate control voltage in response to the drop in the output voltage of the on-chip distributed power network;

controlling a gate voltage of a pass transistor of the digital low-dropout voltage regulator using the gate control voltage generated by the voltage sensing circuit;

wherein providing the current, from the digital low-drop-out voltage regulator, to the on-chip distributed power network in response to the drop in output voltage of the on-chip distributed power network further comprises, providing the current from the pass transistor of the digital low-dropout voltage regulator, to the on-chip distributed power network in response to the drop in output voltage of the on-chip distributed power network; and wherein turning ON the subset of the on-chip voltage regulators while the digital low drop-out voltage regulator is providing the current to the on-chip distributed power network in response to the drop in output voltage of the on-chip distributed power network further comprises, turning ON the subset of the on-chip voltage regulators while the pass transistor of the digital low drop-out voltage regulator is providing the current to the on-chip distributed power network in response to the drop in output voltage of the on-chip distributed power network.

9. The method of claim 6, further comprising, prior to turning ON a subset of the set of on-chip voltage regulators based at least in part on the current demand of the one or more load circuits and the output current of each of the on-chip voltage regulators of the set of on-chip voltage regulators at the selected power-conversion efficiency level, while the first voltage regulator is providing the current to the on-chip distributed power network, asserting a turn-on signal to the subset of on-chip voltage regulators.

10. The method of claim 1, wherein the set of on-chip voltage regulators are selected from the group consisting of low-dropout voltage regulators, switched capacitor voltage regulators and buck converter voltage regulators.

11. A method for adaptive management of an on-chip distributed power network comprising a set of on-chip voltage regulators coupled in parallel to one or more load circuits, the method comprising:

determining an output current at a selected power-conversion efficiency level for each of the on-chip voltage regulators included in the set of on-chip voltage regulators;

determining a current demand of the one or more load circuits coupled to the on-chip voltage regulators;

sensing, with a voltage sensing circuit of at least one digital low-dropout voltage regulator coupled in parallel with the set of on-chip voltage regulators, an output voltage of the on-chip distributed power network;

generating, by the voltage sensing circuit of the at least one digital low-dropout voltage regulator, a gate control voltage in response to a drop in the output voltage of the on-chip distributed power network;

controlling a gate voltage of a pass transistor of the digital low-dropout voltage regulator using the gate control voltage generated by the at least one digital low-dropout voltage regulator;

providing a current, from the pass transistor of the digital low-dropout voltage regulator, to the on-chip distributed power network in response to the drop in output voltage of the on-chip distributed power network; and activating a subset of the set of on-chip voltage regulators based at least in part on the current demand of the one or more load circuits and the output current of each of the on-chip voltage regulators at the selected power-conversion efficiency level.

12. The method of claim 11, further comprising disabling the current from the pass transistor after the subset of on-chip voltage regulators have been activated.

13. A system for adaptive management of an on-chip distributed power network, the system comprising:

an on-chip distributed power network comprising a set of on-chip voltage regulators coupled in parallel to one or more load circuits, each of the on-chip voltage regulators of the set of on-chip voltage regulators having an output current equal to the output current of the voltage regulator at a selected efficiency level;

one or more power sensors configured for determining a current demand of the one or more load circuits coupled to the set of on-chip voltage regulators;

a first voltage regulator configured for sensing an output voltage of the on-chip distributed power network and configured for providing a current to the on-chip distributed power network in response to a drop in output voltage of the on-chip distributed power network; and a power controller coupled to the on-chip distributed power network, the power controller configured for turning ON a subset of the set of on-chip voltage regulators based at least in part on the current demand of the one or more load circuits and the output current of each of the on-chip voltage regulators at the selected power-conversion efficiency level, while the first voltage regulator is providing a current to the on-chip distributed power network in response to the drop in output voltage of the on-chip distributed power network.

14. The system of claim 13, wherein the selected power-conversion efficiency level is a highest efficiency level.

15. The system of claim 13, wherein the subset of the set of on-chip voltage regulators is a minimum number of on-chip voltage regulators required to meet the current demand of the one or more load circuits based at least in part on the output current of each of the plurality of on-chip voltage regulators.

16. The system of claim 13, wherein the power controller is further configured for determining the available power budget of the on-chip distributed power network determining the available power budget of the on-chip distributed power network, for identifying the on-chip voltage regulators that have been turned ON and for turning OFF one or more of the subset of voltage regulators if the power budget is not satisfied by the on-chip voltage regulators that have been turned ON.

17. The system of claim 13, wherein the first voltage regulator is a digital low-dropout voltage regulator coupled in parallel with the set of on-chip voltage regulators, the digital low-dropout voltage regulator comprising a voltage sensing circuit and a pass transistor coupled to the voltage sensing circuit, the voltage sensing circuit configured for sensing the output voltage of the on-chip distributed power network and configured for generating a gate control voltage in response to the drop in the output voltage of the on-chip distributed power network and the pass transistor configured for providing the current to the on-chip distributed power network in response to the drop in output voltage of the on-chip distributed power network; and the power controller further configured for turning ON the subset of on-chip voltage regulators based at least in part on the current demand of the one or more load circuits and the output current at the selected efficiency level of each of the set of on-chip voltage regulators while the digital low-dropout voltage regulator is providing a current to the on-chip distributed power network.

18. The system of claim 17, further comprising disabling the current from the pass transistor after the subset of on-chip voltage regulators have been turned ON.

19. The system of claim 17, wherein the voltage sensing circuit comprises two skewed inverters.

20. The system of claim 17, further comprising, prior to turning ON a subset of the set of on-chip voltage regulators based at least in part on the current demand of the one or more load circuits and the output current at the selected efficiency level of each of the set of on-chip voltage regulators, asserting a turn-on signal to the subset of on-chip voltage regulators.

21. The system of claim 15, wherein the set of on-chip voltage regulators are selected from the group consisting of low-dropout voltage regulators, switched capacitor voltage regulators and bus converter voltage regulators.

* * * * *